US007614447B2

(12) United States Patent
Jennings

(10) Patent No.: US 7,614,447 B2
(45) Date of Patent: Nov. 10, 2009

(54) SYSTEM, METHOD, AND APPARATUS FOR ENERGIZABLE METAL SEALS IN WELL HEADS

(75) Inventor: Charles E. Jennings, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 255 days.

(21) Appl. No.: 11/796,096

(22) Filed: Apr. 26, 2007

(65) Prior Publication Data

US 2008/0265517 A1 Oct. 30, 2008

(51) Int. Cl.
*E21B 33/03* (2006.01)

(52) U.S. Cl. ..... 166/84.1; 277/339; 277/566; 277/647

(58) Field of Classification Search ..... 166/84.1; 277/328, 339, 566, 567, 647
See application file for complete search history.

(56) References Cited

U.S. PATENT DOCUMENTS 2,075,947 A * 4/1937 Kennedy ..... 277/626
4,131,287 A 12/1978 Gunderson et al.
4,588,030 A * 5/1986 Blizzard ..... 166/120
5,044,672 A 9/1991 Skeels et al.
5,110,144 A * 5/1992 Burton et al. ..... 277/328
5,129,660 A * 7/1992 Taylor et al. ..... 277/328
5,246,236 A * 9/1993 Szarka et al. ..... 277/337
2008/0135229 A1* 6/2008 Hunter et al. ..... 166/84.1

FOREIGN PATENT DOCUMENTS

EP 0475557 B1 12/1995
EP 0579393 B1 2/1998
GB 2444826 A 6/2008

* cited by examiner

*Primary Examiner*—David J Bagnell
*Assistant Examiner*—Nicole A Coy
(74) *Attorney, Agent, or Firm*—Bracewell & Giuliani

(57) ABSTRACT

A bi-directional metal seal is energized and un-energized by a rolling action that takes place between radiused seal lips. The seal forms an assembly with upper and lower energizing rings. The rings have external grooves for engaging hook ends on the inner surfaces of the seal lips in a nesting arrangement when the seal is in the un-energized position. When the upper ring is pulled upward, the seal is un-energized and does not contact the adjacent conductors or wellhead members. When the upper ring is forced downward, the hooks ends of the seal are forced out of the grooves causing the seal lips to roll around in a radial outward direction, rather than stretch, and expand against the seal's outer diameter. This energizing process also causes the seal to become smaller on the seal's inner diameter, and thus forms a pressure-assist, metal-to-metal seal with the adjacent conductors.

20 Claims, 5 Drawing Sheets

SYSTEM, METHOD, AND APPARATUS FOR ENERGIZABLE METAL SEALS IN WELL HEADS

BACKGROUND OF THE INVENTION

1. Technical Field

The present invention relates in general to wellhead assemblies and, in particular, to an improved system, method, and apparatus for forming a metal seal between inner and outer wellhead members.

2. Description of the Related Art

As shown in FIG. 1, seals 11 are used between inner and outer wellhead tubular members 13, 15 to contain internal well pressure. The inner wellhead member may be a tubing hanger that supports a string of tubing extending into the well for the flow of production fluid. The tubing hanger lands in an outer wellhead member, which may be a wellhead housing, a Christmas tree, or tubing head. A packoff or seal seals between the tubing hanger and the outer wellhead member. Alternately, the inner wellhead member might be a casing hanger located in a wellhead housing and secured to a string of casing extending into the well. A seal or packoff seals in the annular space between the casing hanger and the wellhead housing.

A variety of seals of this nature have been employed in the prior art. Prior art seals include elastomeric seals 17 (see, e.g., FIG. 2) and partially metal anti-extrusion rings backing up elastomeric seal rings. Prior art seal rings made entirely of metal for forming metal-to-metal seals are also employed. The seals may be set by a running tool, or they may be set in response to the weight of the string of casing or tubing. One type of prior art metal-to-metal seal 19 (see, e.g., FIG. 3) has a U-shaped cross-sectional shape with inner and outer walls separated by a conical slot. An energizing ring 21 is pushed into the slot to deform the inner and outer walls apart into sealing engagement with the inner and outer wellhead members 13, 15. The energizing ring is a solid wedge-shaped member. The deformation of the inner and outer walls exceeds the yield strength of the material of the seal ring, making the deformation permanent.

Thermal growth between the casing or tubing and the wellhead may occur, particularly with wellheads located at the surface, rather than subsea. The well fluid flowing upward through the tubing heats the string of tubing, and to a lesser degree the surrounding casing. The temperature increase may cause the tubing hanger and/or casing hanger to move axially a slight amount relative to the outer wellhead member. During the heat up transient, the tubing hanger and/or casing hanger can also move radially due to temperature differences between components and the different rates of thermal expansion from which the component materials are constructed. If the seal has been set as a result of a wedging action where an axial displacement of energizing rings induces a radial movement of the seal against its mating surfaces, then sealing forces may be reduced if there is movement in the axial direction due to pressure or thermal effects. A reduction in axial force on the energizing ring results in a reduction in the radial inward and outward forces on the inner and outer walls of the seal ring, which may cause the seal to leak. A loss of radial loading between the seal and its mating surfaces due to thermal transients may also cause the seal to leak.

SUMMARY OF THE INVENTION

One embodiment of a system, method, and apparatus for sealing between inner and outer well members utilizes a bi-directional metal seal that is energized and un-energized by a rolling action that takes place between radiused seal lips. The seal forms an assembly with upper and lower energizing rings. The energizing rings have opposing grooves on the o.d. and i.d. for engaging hook ends on the inner surfaces of the seal lips in a nesting arrangement when the seal is in the un-energized position. When the upper ring is pulled upward, the seal is un-energized and does not contact the adjacent conductors or wellhead members. When the upper ring is forced downward, the hooks ends in the seal's inner cavity are forced out of the grooves of the energizing ring (i.e., moving from the thinnest section of the energizing ring, out to the thickest section), causing the seal lips to spread apart and roll around in a radial outward direction, rather than stretch. This process increases the seal's outer diameter and decreases the seal's inner diameter, causing the seal to form a pressure-assist, metal-to-metal seal between the adjacent conductors.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention, which will become apparent, are attained and can be understood in more detail, a more particular description of the invention briefly summarized above may be had by reference to the embodiments thereof that are illustrated in the appended drawings which form a part of this specification. It is to be noted, however, that the drawings illustrate only some embodiments of the invention and therefore are not to be considered limiting of its scope as the invention may admit to other equally effective embodiments.

DETAILED DESCRIPTION OF THE INVENTION

Figure 1:
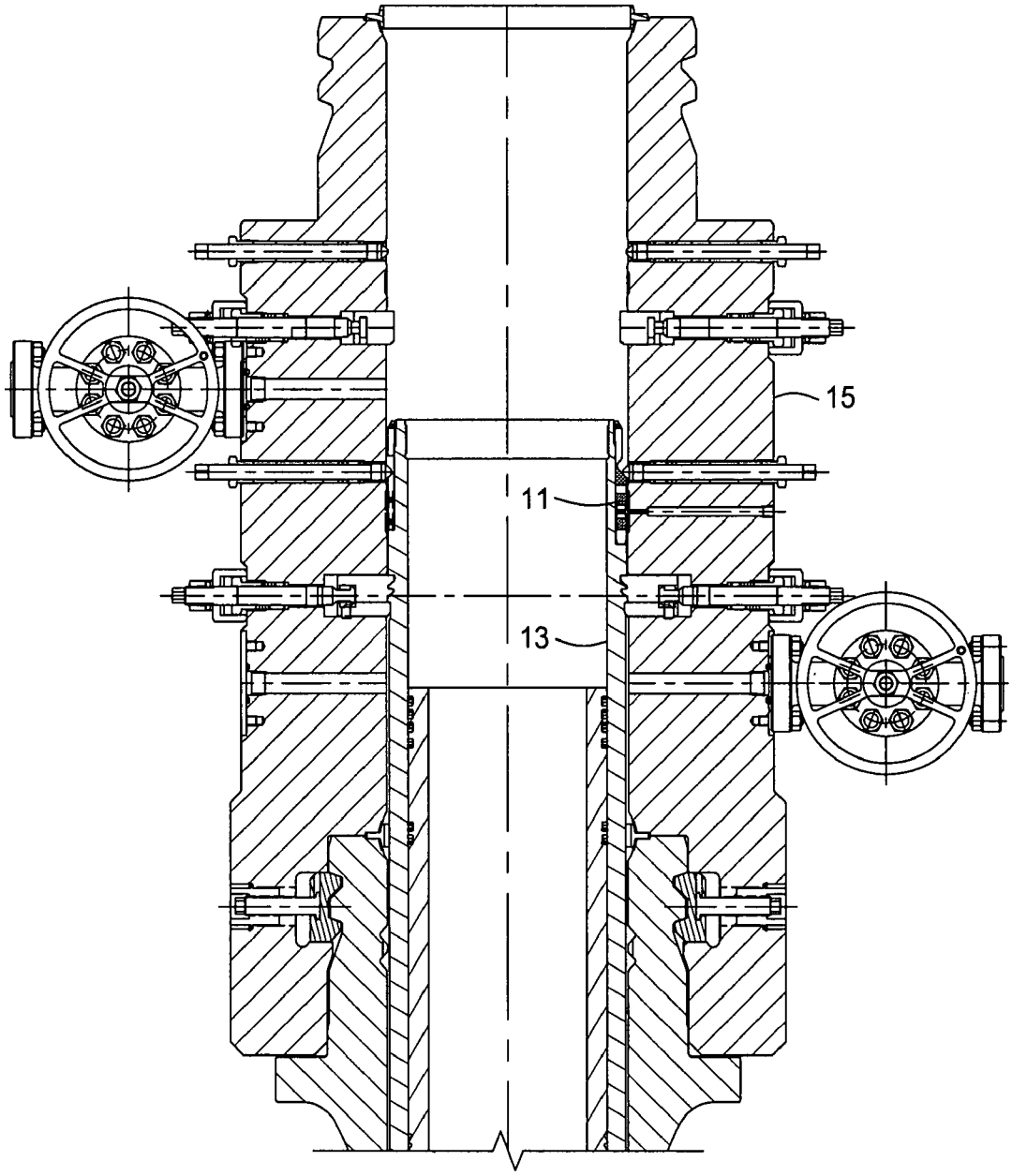
FIG. 1 (PRIOR ART)
FIG. 1 is a sectional side view of a conventional surface wellhead assembly.
Figure 2:
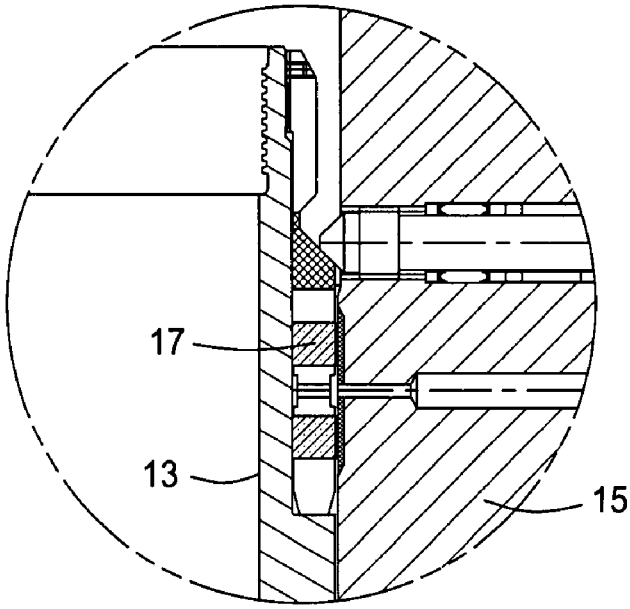
FIG. 2 (PRIOR ART)
FIG. 2 is an enlarged sectional side view of one type of prior art seal assembly for the wellhead assembly of FIG. 1.
Figure 3:
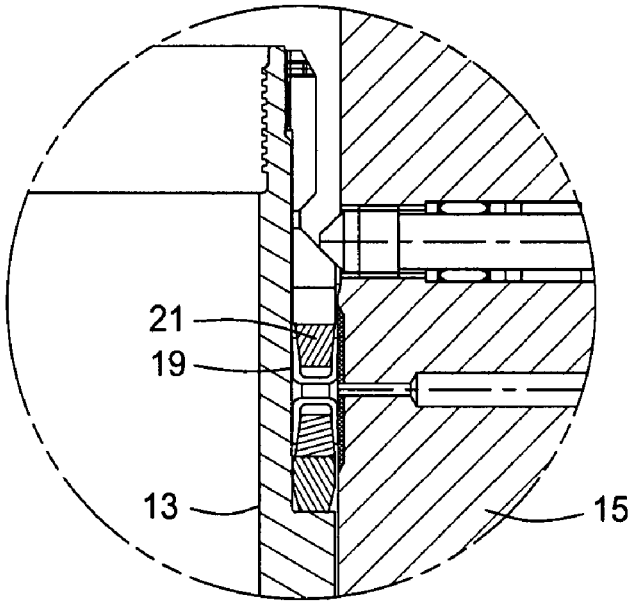
FIG. 3 (PRIOR ART)
FIG. 3 is an enlarged sectional side view of another type of prior art seal assembly for the wellhead assembly of FIG. 1.
Figure 4:
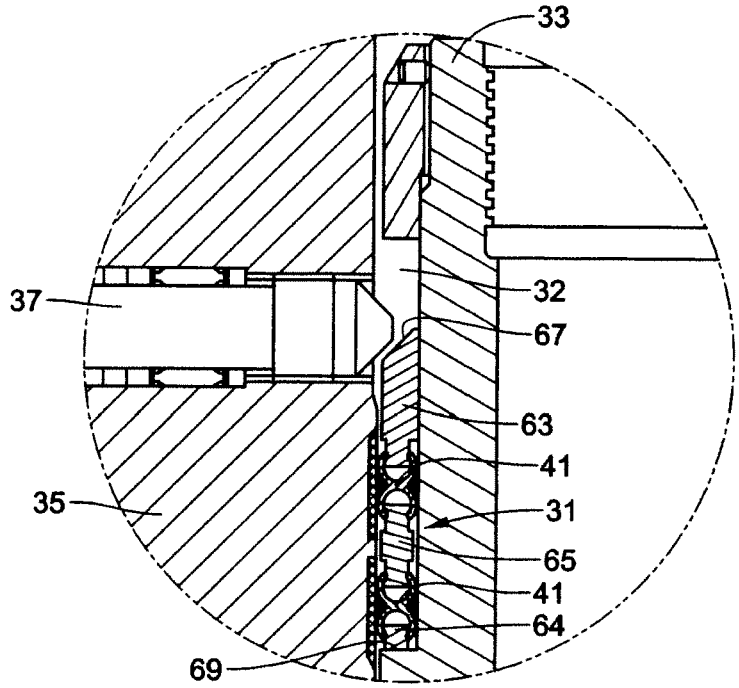
FIG. 4 is an enlarged sectional side view of one embodiment of a seal assembly for a wellhead assembly shown in an un-energized position and is constructed in accordance with the invention.
Figure 5:
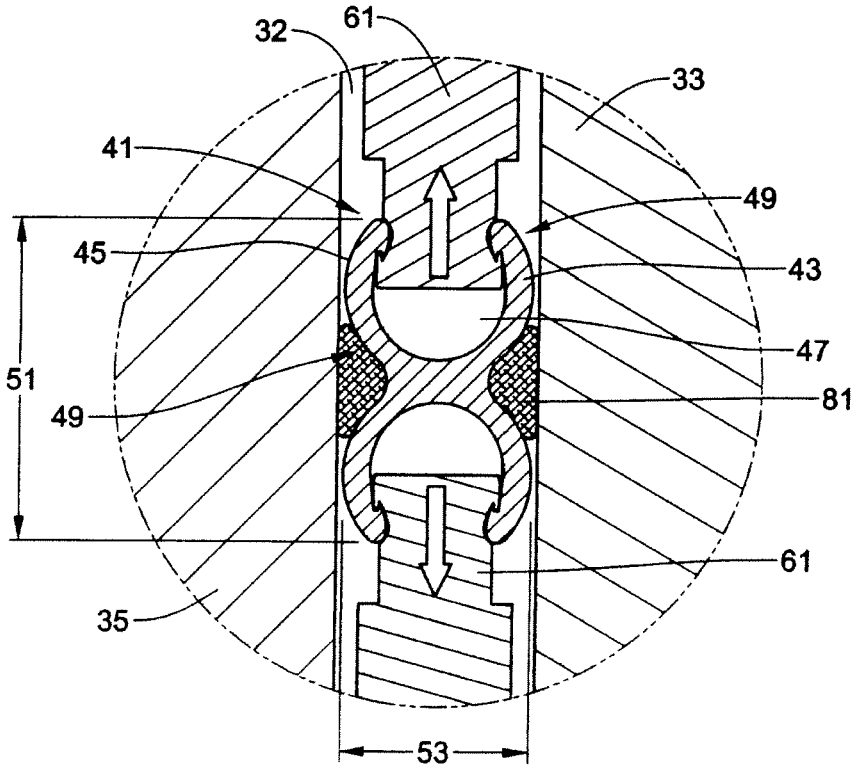
FIG. 5 is a further enlarged sectional side view of the seal assembly of FIG. 4 in the un-energized position and is constructed in accordance with the invention.

Referring to FIGS. 4-7, one embodiment of system, method, and apparatus for forming a metal wellhead seal assembly between inner and outer wellhead members is disclosed. The wellhead seal assembly 31 is located in an annular space or annulus 32 (FIG. 4) that is radially between a set of co-axial wellhead members 33, 35. A radially-movable member 37 is located in and extends through outer wellhead member 35 for actuating the wellhead seal assembly 31 between an engaged or energized position (FIGS. 6 and 7), and unengaged or un-energized position (FIGS. 4 and 5).

Figure 6:
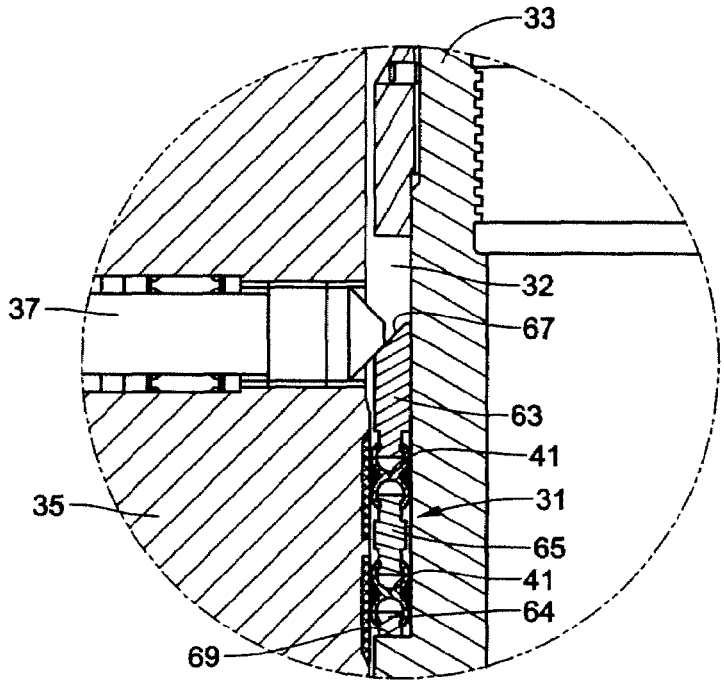
FIG. 6 is an enlarged sectional side view of the seal assembly of FIG. 4 shown in an energized position and is constructed in accordance with the invention.

The wellhead seal assembly 31 comprises at least one seal ring 41 (e.g., one shown in FIGS. 5 and 7) that are formed from metal. In FIGS. 4 and 6, two seal rings 41 are shown and are axially spaced apart from each other in annulus 32 relative to wellhead members 33, 35. As best shown in FIG. 5, the seal ring 41 has inner and outer walls 43, 45 curving toward each other on the open end and spaced apart to form a slot 47 between walls 43, 45. In the embodiment shown, each seal ring 41 comprises a first or upper set of inner and outer walls 43, 45, a second or lower set of inner and outer walls 43, 45 located axially opposite the upper set, and both sets of the inner and outer walls 43, 45 are separated by respective slots 47. The slots 47 are formed on a radius and have an arcuate cross-sectional profile. In one embodiment, both sets of the inner and outer walls 43, 45 of the seal ring 41 have exterior surfaces 49 that are radiused to define a seal ring cross-sectional shape having inner and outer profiles that are both arcuate in shape.

Figure 7:
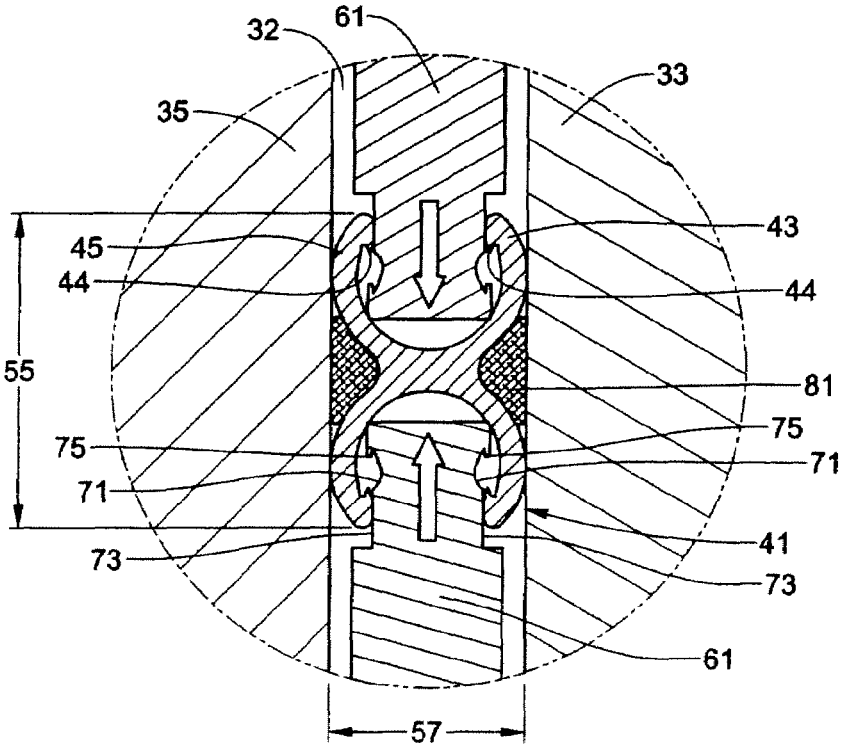
FIG. 7 is a further enlarged sectional side view of the seal assembly of FIG. 6 in the energized position and is constructed in accordance with the invention.

In one embodiment, the seal ring 41 has an axial length 51 (FIG. 5) and a radial width 53 in the un-energized position. However, in the energized position (FIG. 7), the seal ring 41 shortens in axial length 55 and expands in radial width 57 (i.e., to the width of the annulus 32) relative to length 51 and width 53 of the un-energized position. As shown in FIGS. 5 and 7, optional elastomeric members 81 may be located between axially central portions of seal rings 41 and the surfaces of the wellhead members 33, 35.

The wellhead seal assembly 31 further comprises one or more solid energizing rings 61 that are formed from metal. Each energizing ring 61 is associated with one of the sets of inner and outer walls 43, 45. For example, in FIGS. 5 and 7 a pair of energizing rings 61 is shown, but in FIGS. 4 and 6, two single-ended energizing rings 63, 64 and one double-ended energizing ring 65 are shown. In the embodiment shown, upper energizing ring 63 has a chamfer 67 for sliding engagement with radially-movable member 37, and lower energizing ring 64 is located on an orthogonal shoulder 69 formed on the outer surface of inner wellhead member 33.

As best shown in FIG. 7, each set of the inner and outer walls 43, 45 of the seal ring 41 terminates in seal lips having recessed edges 44, forming hooks that extend along interior surfaces thereof. Each energizing ring 61 has inner and outer surfaces that are generally concave in cross-sectional shape. In one embodiment, each inner and outer surface comprises external grooves 71 that engage and mate with respective ones of the recessed edges 44 in a nesting configuration in the un-energized position. Located axially on either side of grooves 71 are a neck 73 on a proximal end thereof, a hooked feature 75 on a distal end thereof, with the groove 71 forming the concave cross-sectional shape between the proximal and distal ends. In the energized position, the distal ends of the seal rings engage the necks 73 and the distal ends of the energizing rings 61 abut axially interior portions of the slots 47 to elastically deform the inner and outer walls 43, 45 of the seal rings 41. In the un-energized position, the distal ends of the seal rings 41 seat in the grooves 71 and the hooked features interlock with features 44 inside the inner and outer walls 43, 45 of the seal rings 41 to retain the energizing rings 61 in the internal slots 47.

The inner and outer surfaces of energizing rings 61 slidingly engage the inner and outer walls 43, 45 of the slots 47 in the seal rings 41 between the energized position wherein the inner and outer walls 43, 45 elastically deform into bi-directional sealing engagement with the inner and outer wellhead members 33, 35. In the un-energized position, the inner and outer walls 43, 45 of seal ring 41 do not form a seal between the inner and outer wellhead members 33, 35. In the energized position, the seal lips of seal rings 41 are forced out of the external grooves 71 causing the seal lips to roll around in a radial outward direction, rather than stretch, and expand both sets of walls 43, 45 against the inner and outer wellhead members 33, 35.

Figure 8:
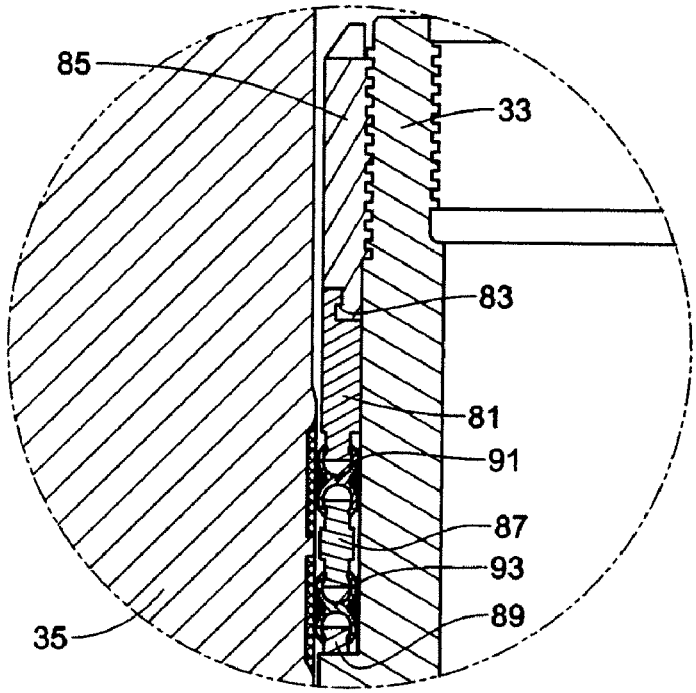
FIG. 8 is an enlarged sectional side view of an alternate embodiment for actuating the seal assembly, shown in the un-energized position, and is constructed in accordance with the invention.

Referring now to FIG. 8, an alternate embodiment for actuating the seal assembly is depicted with the seal in the un-energized position. The upper energizing ring 81 is provided with a circumferential, radially internal flange 83 that is mechanically coupled to an axially movable ring 85. In one embodiment, ring 85 is threaded to and reacts in response to inner wellhead member 33 as shown. Ring 85 is used to axially stroke (i.e., push and retract) energizing ring 81 and, thereby, the other energizing rings 87, 89 to manipulate seal rings 91, 93, respectively, between the energized and un-energized positions as described herein.

While the invention has been shown or described in only some of its forms, it should be apparent to those skilled in the art that it is not so limited, but is susceptible to various changes without departing from the scope of the invention.

What is claimed is:

1. A wellhead seal assembly for sealing between inner and outer wellhead members, comprising:

a seal ring formed from metal and having inner and outer walls, each wall having an interior surface separated from the other interior surface, defining a slot, each wall having an exterior surface;

the seal ring having an un-energized position wherein the interior surfaces and the exterior surfaces of the walls are arcuate when viewed in a cross-sectional view; and an energizing ring formed from metal and having inner and outer surfaces that are located in the slot and slidingly engage the inner and outer walls of the seal ring to move the inner and outer walls to an energized position in sealing engagement with the inner and outer wellhead members.

2. A wellhead seal assembly according to claim 1, wherein in the un-energized position, the exterior and interior surfaces of the outer wall are parallel with each other, and the exterior and interior surfaces of the inner wall are parallel with each other.

3. A wellhead seal assembly according to claim 1, wherein each of the inner and outer walls of the seal ring terminate in seal lips having recessed edges extending along the interior surfaces thereof, and the energizing ring has external grooves that engage the recessed edges in a nesting configuration in the un-energized position.

4. A wellhead seal assembly according to claim 3, wherein, the inner and outer surfaces of the energizing ring have cylindrical portions beginning at the grooves that sliding engage the seal lips when moving from the un-energized to the energized position, forcing the seal lips apart from each other to move the inner and outer walls against the inner and outer wellhead members.

5. A wellhead seal assembly according to claim 1, wherein the seal ring has a base opposite distal ends of the inner and outer walls, and in the un-energized position, the seal ring has a radial width measured from the exterior surface of the inner wall to the exterior surface of the outer wall at the base that is less than at an intermediate point between the base and the distal ends.

6. A wellhead seal assembly according to claim 1, wherein the seal ring comprises a bi-directional metal seal having upper and lower slots for engaging upper and lower energizing rings, respectively, the seal ring having a generally figure eight configuration in cross-section while in the un-energized configuration.

7. A wellhead seal assembly according to claim 1, wherein the inner and outer surfaces of the energizing ring have concentric, cylindrical portions, and when the energizing ring is actuated to the energized position, the cylindrical portions engage distal ends of the inner and outer walls of the seal ring.

8. A wellhead seal assembly according to claim 1, wherein each of the inner and outer surfaces of the energizing ring comprises:

a neck on a proximal end thereof;

a hooked feature on a distal end thereof; and a groove forming a concave cross-sectional shape between the proximal and distal ends;

wherein, in the energized position, distal ends of the seal ring engage the neck and distal ends of the energizing ring abut an axially interior portion of the slot to elastically deform the inner and outer walls of the seal ring; and in the un-energized position, the distal ends of the seal ring seat in the grooves and the hooked features interlock with seal lips located on the inner and outer walls of the seal ring to retain the energizing member in the slot; and the deformation of the inner and outer walls between the un-energized and the energized positions is elastic.

9. A wellhead seal assembly for sealing between coaxial inner and outer wellhead members, comprising:

a seal ring formed from metal and having a first set of inner and outer walls, a second set of inner and outer walls located axially opposite the first set, and both sets of the inner and outer walls are separated by respective slots, each of the slots having a generally circular shape in cross-section with an opening at distal ends of the inner and outer walls while the seal ring is in an un-energized position; and an energizing ring associated with each of the first and second set of inner and outer walls to define a pair of energizing rings, each formed from metal and having inner and outer surfaces that slidingly engage the distal ends of the inner and outer walls of the slots in the seal ring between an energized position wherein the inner and outer walls are deformed into a bi-directional sealing engagement with the inner and outer wellhead members, and the un-energized position wherein the inner and outer walls do not form a seal between the inner and outer wellhead members.

10. A wellhead seal assembly according to claim 9, wherein both sets of the inner and outer walls of the seal ring have exterior surfaces that are generally circular in shape when viewed in a cross-sectional view.

11. A wellhead seal assembly according to claim 9, wherein each set of the inner and outer walls of the seal ring terminates in seal lips having recessed edges extending along interior surfaces thereof, and each of the energizing rings has external grooves that engage respective ones of the seal lips in a nesting configuration in the un-energized position, the grooves being curved when viewed in a cross-sectional view.

12. A wellhead seal assembly according to claim 11, wherein:

each of the energizing rings has a neck with cylindrical surfaces extending from the grooves; and when moved to the energized position, the seal lips are forced out of the external grooves into engagement with the cylindrical surfaces of the neck.

13. A wellhead seal assembly according to claim 9, wherein the seal ring has a base equidistant between the distal ends of the first and second sets of inner and outer walls, and in the un-energized position, the seal ring has a radial width at the base that is less than a radial width between exterior surfaces of the first set of inner and outer walls at a point intermediate the base and the distal ends of the first set of inner and outer walls.

14. A wellhead seal assembly according to claim 9, wherein: the seal ring has a base located equidistant between the distal ends of the first and second sets of inner and outer walls; and the first and second sets of inner and outer walls have substantially constant thicknesses from the base to the distal ends.

15. A wellhead seal assembly according to claim 9, wherein each of the inner and outer surfaces of the energizing rings comprises a neck on a proximal end thereof, a hooked feature on a distal end thereof, and a groove forming a curved concave cross-sectional shape between the proximal and distal ends of the energizing rings, wherein, in the energized position, the distal ends of the seal rings engage the necks, and, in the un-energized position, the distal ends of the seal rings seat in the grooves and the hooked features interlock with seal lips located on the inner and outer walls of the seal rings to retain the energizing rings in the slots.

16. A wellhead assembly, comprising:

inner and outer wellhead members having an annulus therebetween;

a wellhead seal assembly located in the annulus and having an axis; comprising:

a plurality of metal seal rings, each having a first set of inner and outer walls, a second set of inner and outer walls located axially opposite the first set, and both sets of the inner and outer walls are separated by respective slots facing in opposite directions;

the inner and outer walls of each set having an exterior surface that convexly curves from a distal end to a proximal end of each of the inner and outer walls while in an un-energized and an energized position, placing a midpoint of the exterior surface of the inner walls closer to the axis than any other portion of the inner walls, and placing a midpoint of the exterior surfaces of the outer walls farther outward from the axis than any other portion of the outer walls; and a plurality of metal energizing rings, each being associated with one of seal rings, each energizing ring having inner and outer surfaces that slidingly engage the inner and outer walls of the slots in the seal rings when moving to the energized position wherein the midpoints of the inner and outer walls are in sealing engagement with the inner and outer wellhead members.

17. A wellhead assembly according to claim 16, wherein each of the inner and outer walls of the seal rings has interior surfaces that are parallel with the exterior surfaces.

18. A wellhead assembly according to claim 16, wherein:

each set of the inner and outer walls of the seal rings terminates in seal lips having recessed edges extending along interior surfaces thereof, and each of the energizing rings has external grooves that engage respective ones of the recessed edges in a nesting configuration in the un-energized position;

in the energized position, the seal lips are forced out of the external grooves causing the seal lips to expand both sets of the inner and outer walls against the inner and outer wellhead members; and the grooves are curved when viewed in a cross-sectional view.

19. A wellhead assembly according to claim 16, wherein, in the un-energized position, each of the seal rings has a radial width that is greater between the midpoints than at any other portion of the seal rings.

20. A wellhead assembly according to claim 16, wherein each of the inner and outer surfaces of the energizing rings comprises a neck having cylindrical inner and outer surfaces on a proximal end thereof, a hooked feature on a distal end thereof, and a groove forming the concave cross-sectional shape between the proximal and distal ends, wherein, in the energized position, distal ends of the seal rings engage the cylindrical inner and outer surfaces of the necks and distal ends of the energizing rings abut axially interior portions of the slots to elastically deform the inner and outer walls of the seal rings, and, in the un-energized position, the distal ends of the seal rings seat in the grooves and the hooked features interlock with seal lips located on the inner and outer walls of the seal rings to retain the energizing rings in the slots.

* * * * *